US007744700B2

(12) United States Patent
Kozy et al.

(10) Patent No.: US 7,744,700 B2
(45) Date of Patent: Jun. 29, 2010

(54) AQUEOUS TUBE CLEANING APPARATUS AND METHOD

(75) Inventors: David M. Kozy, Kent, WA (US); Daniel L. Nydegger, Auburn, WA (US); Wiliam R. Schell, Federal Way, WA (US); Kin Y. Wong, Renton, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/399,959

(22) Filed: Mar. 8, 2009

(65) Prior Publication Data

US 2009/0165827 A1 Jul. 2, 2009

Related U.S. Application Data

(62) Division of application No. 11/044,221, filed on Jan. 28, 2005, now Pat. No. 7,520,287.

(51) Int. Cl.
*B08B 9/02* (2006.01)

(52) U.S. Cl. ..... 134/22.12; 134/25.1; 134/26

(58) Field of Classification Search ..... None
See application file for complete search history.

(56) References Cited

U.S. PATENT DOCUMENTS

| | | | | |
|---|---|---|---|---|
| 620,224 | A | 2/1899 | Bubser | |
| 2,967,120 | A | 1/1961 | Chaney | |
| 4,310,010 | A * | 1/1982 | Svoboda | 134/135 |
| 4,381,016 | A * | 4/1983 | Douglas et al. | 134/170 |
| 4,572,564 | A | 2/1986 | Cipolla | |
| 4,877,138 | A | 10/1989 | Motiwala | |
| 5,460,064 | A | 10/1995 | Zayat, Jr. | |
| 5,896,889 | A | 4/1999 | Menard | |
| 6,070,600 | A * | 6/2000 | Grootegoed et al. | 134/111 |
| 6,115,541 | A | 9/2000 | Rhodes | |
| 6,471,422 | B1 | 10/2002 | Ueda et al. | |
| 6,557,600 | B1 | 5/2003 | VeNard | |
| 6,682,313 | B1 | 1/2004 | Sulmone | |
| 2002/0096199 | A1 | 7/2002 | Duckett et al. | |
| 2003/0077396 | A1 | 4/2003 | LeCompte et al. | |
| 2003/0230827 | A1 | 12/2003 | Soh | |
| 2004/0047942 | A1 | 3/2004 | Vasapoli et al. | |

OTHER PUBLICATIONS

Guyson International, "MARR-Line—Conveyorised tunnel washers," available at <http://www.guyson.co.uk/wash/index2.html>, last visited Sep. 22, 2009.

Guyson International, "Gyroforce," available at <http://www.guyson.co.uk/wash/index2.html>, last visited Sep. 22, 2009.

Guyson International, "Guyson Cellmate 200—Return-to-Front Tunnel Wash System," and believed to be "Carousel Wash System" document dated Jul. 31, 2002.

* cited by examiner

*Primary Examiner*—Michael Kornakov
*Assistant Examiner*—Ryan Coleman

(57) ABSTRACT

An aqueous tube cleaning apparatus and method includes a cleaning receptacle and a vertical receptacle, which is taller than the cleaning receptacle. A tube, or bundle of tubes, is placed in the cleaning receptacle, extending through an inlet port from the vertical receptacle, and a gate is closed to clamp the tubes in place. The vertical receptacle is then filled with a fluid, and the pressure created by gravity forces the fluid through and around the tubes, cleansing the inner and outer surfaces of the tubes.

20 Claims, 6 Drawing Sheets

AQUEOUS TUBE CLEANING APPARATUS AND METHOD

CROSS-REFERENCE TO RELATED APPLICATIONS

This application is a divisional of and claims priority to U.S. application Ser. No. 11/044,221 filed on Jan. 28, 2005 and entitled AQUEOUS TUBE CLEANING APPARATUS AND METHOD, the entire contents of which is expressly incorporated herein by reference.

FIELD

The present disclosure relates generally to industrial parts washers. More particularly, the present disclosure relates to aqueous tube cleaning systems and methods.

BACKGROUND

During manufacturing, machine parts often must be cleaned to remove metal chips, lubricating oils and contaminants before being installed in an assembly or being delivered. In addition, used parts often must be cleaned during overhaul or maintenance operations. As a result, a wide variety of methods and devices have been developed to cleanse parts. Industrial parts washers may be developed for general use or for specific applications. Industrial parts washers are utilized in a wide variety of industries. For example, extensive use is found in the automotive industry, the aerospace industry, the agricultural equipment industry, the heavy equipment industry, and the computer industry. Furthermore, industrial parts washers have been developed to remove a wide variety of contaminants, including, for example, carbon residue, grease, grinding compounds, oils, lubricants, metal burrs, metal working fluids, mold release, particulates, rust, soil, and wax.

Depending on the application, industrial parts washers have been designed using an assortment of cleaning methods. For example, immersion cleaning equipment typically is outfitted with baskets or screened trays to handle parts that cannot tolerate rotation or tumbling. Spray washers, or pressure parts washers, clean parts by directing a pressurized spray of hot water or cleaning solution at a component. Immersion parts washers clean components by submerging them in an agitated cleaning solution contained in a wash tank. Solvent washers use chemical solvents to clean or degrease, typically immersing parts in a liquid solvent or utilizing spray nozzles to disperse the solvent for additional cleaning. Ultra-sonic cleaning systems use vibration developed by uniformly dispersing ultrasonic cavitation into a fluid surrounding the parts or components. Forced-flow systems channel pressurized fluid through a cavity in the parts, such as tubing.

Industrial washers also come in a wide range of sizes, from small table-top washing machines or small scrub tank sinks to large front-loading turntable or conveyor cleaning systems. These systems may be designed for general cleaning or for highly specialized applications, such as critical cleaning systems of electronics components or wafers, bottle or container cleaners, or sterilizing and disinfecting cleaners for pharmaceutical and food applications. Included among these specialized applications of specific industrial parts washers are tube cleaning systems.

Tube cleaning systems apply various methods to deliver a cleaning solution to each tube. For example, some tube cleaning systems utilize flexible hose connections, inserting an individual hose into each tube to ensure delivery of cleaning solution to each tube. However, this requires significant labor, because each tube must be individually fitted to a hose connector. Furthermore, the tube sizes that can be cleaned are limited by the size of the hose connectors. In addition, some tube cleaning systems use solvents that require special handling and disposal. Other tube cleaning systems require excessively high fluid flow rates to clean large tubes. Moreover, many tube cleaning systems are designed for large batch processes, and cannot be adapted for use in an efficient cellular manufacturing scheme.

Despite the number and variety of industrial cleaning systems available, specific applications continue to require the development of new industrial parts washers. Accordingly, it is desirable to provide a method and apparatus that uses an aqueous cleaning solution to clean tubing of a range of diameters, capable of accommodating small diameter and large diameter tubes simultaneously without requiring that the individual tubes be held in place by individual fixtures. It is also desirable that the method and apparatus be capable of cleaning large diameter tubing without requiring excessive fluid flow rates. Furthermore, it is desirable that the cleaning system be portable and sized for use in an efficient cellular manufacturing scheme.

SUMMARY

The foregoing needs are met, to a great extent, by the present disclosure, wherein in one aspect a method and apparatus are provided that in some embodiments use an aqueous cleaning solution to clean tubing of a range of diameters. This method and apparatus accommodate small diameter and large diameter tubes simultaneously without requiring that the individual tubes be held in place by individual fixtures, and is capable of cleaning large diameter tubing without requiring excessive fluid flow rates. Furthermore, the method and apparatus comprise a compact cellular design.

In accordance with one aspect of the present disclosure, a tube cleaning apparatus for cleaning a tube having an inner and outer surface is provided which includes a cleaning receptacle to contain a fluid. A vertical receptacle adjacent to the cleaning receptacle contains a fluid, and is taller than the cleaning receptacle. An inlet port provides fluid communication between the vertical receptacle and the cleaning receptacle, and a gate is slidably attached to the inlet port to allow for at least partial blocking of the inlet port and to clamp a tube, or bundle of tubes, in place through the inlet port. Pressure due to gravity forces the fluid in the vertical receptacle to flow through and around the tube, or tubes, through the inlet port into the cleaning receptacle, thereby cleaning the inner and outer surfaces of the tube, or tubes.

In accordance with another aspect of the present disclosure, a method of cleaning a tube, or a bundle of tubes, having an inner and outer surface is provided, which includes the steps of clamping the tube in place through an inlet port between a vertical receptacle and a cleaning receptacle, the vertical receptacle being taller than the cleaning receptacle. A fluid is supplied to the vertical receptacle and channeled through and around the clamped tube, or tubes, thereby cleaning the inner and outer surfaces of the tube, or tubes.

In accordance with yet another aspect of the present disclosure, a tube cleaning apparatus for cleaning a tube, or a bundle of tubes, having an inner and outer surface is provided which includes means for clamping at least one tube in place through an inlet port between a vertical receptacle and a cleaning receptacle, the vertical receptacle being taller than the cleaning receptacle. The apparatus also includes means for supplying a fluid to the vertical receptacle, as well as means for channeling the fluid through and around the clamped tube, or tubes, thereby cleaning the inner and outer surfaces of the tube, or tubes.

There has thus been outlined, rather broadly, certain embodiments of the disclosure in order that the detailed description thereof herein may be better understood, and in order that the present contribution to the art may be better appreciated. There are, of course, additional embodiments of the disclosure that will be described below and which will form the subject matter of the claims appended hereto.

In this respect, before explaining at least one embodiment of the disclosure in detail, it is to be understood that the disclosure is not limited in its application to the details of construction and to the arrangements of the components set forth in the following description or illustrated in the drawings. The disclosure is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

DETAILED DESCRIPTION

An embodiment in accordance with the present disclosure provides an aqueous tube cleaning system including a cleaning receptacle, a vertical receptacle, an inlet port between the two receptacles, and a gate for opening and closing the inlet port passageway. A tube, or a bundle of tubes, is placed in the cleaning receptacle, extending through the inlet port into the vertical receptacle, and the gate is closed to clamp the tube, or bundle of tubes, in place through the inlet port. The vertical receptacle is filled with a fluid to provide pressure, forcing the fluid in the vertical receptacle to flow through and around the tube or tubes into the cleaning receptacle, cleansing the inner and outer surfaces of the tube or bundle of tubes.

Figure 1:
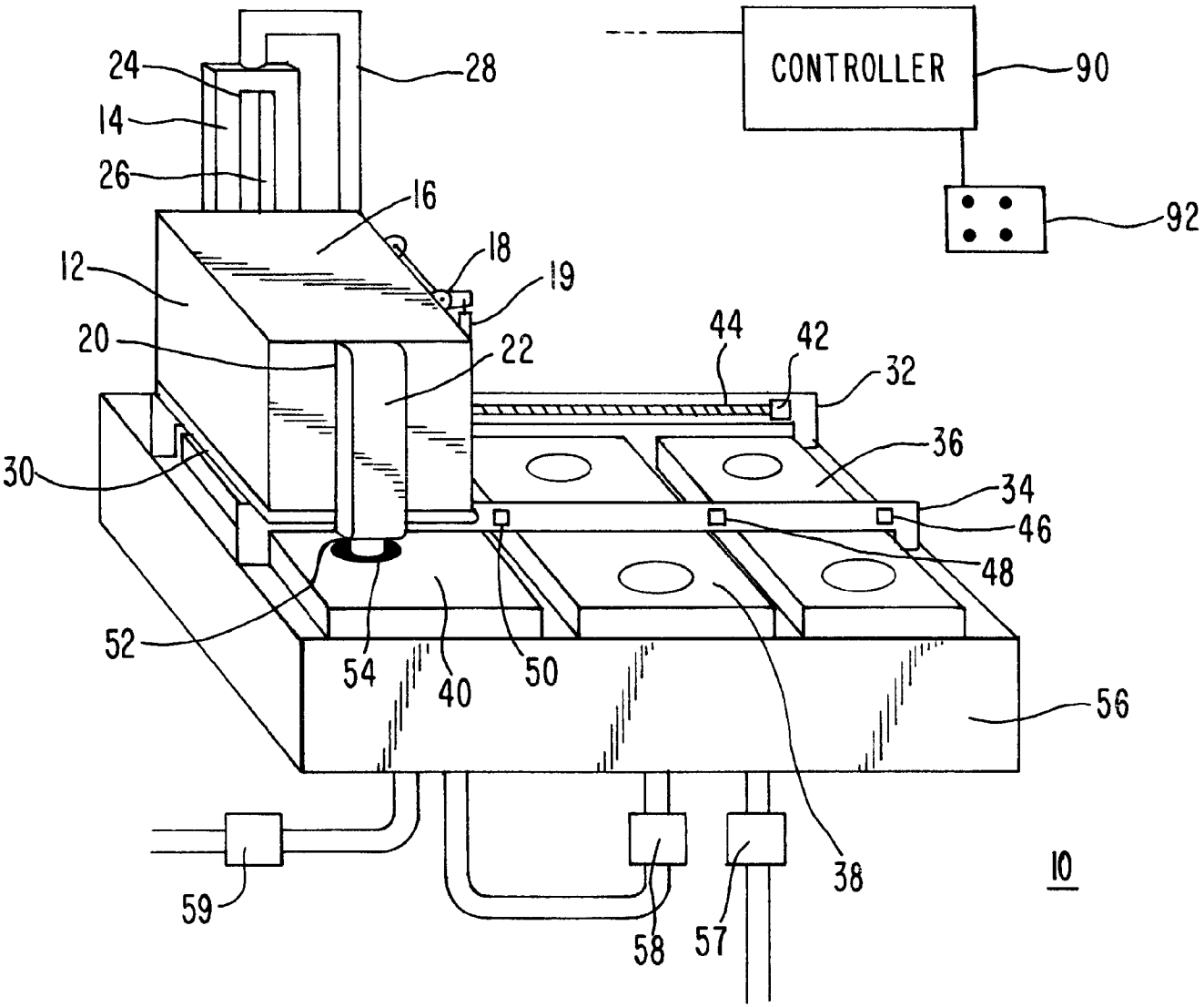
FIG. 1 is a perspective view illustrating an aqueous tube cleaning apparatus according to a preferred embodiment of the disclosure.

Embodiments of the disclosure will now be described with reference to the drawing figures, in which like reference numerals refer to like parts throughout. An embodiment of the present apparatus and method is illustrated in FIG. 1, which shows an aqueous tube cleaning apparatus 10. The tube cleaning apparatus 10 includes a cleaning receptacle, or tank, 12 and a vertical receptacle, or tank, 14 connected to the cleaning receptacle 12, such that the vertical receptacle 14 is taller than the cleaning receptacle 12. In a preferred embodiment, the cleaning tank 12 and the vertical tank 14 are constructed of welded polypropylene plastic.

The cleaning receptacle 12 includes a movable lid 16 connected to the cleaning receptacle 12 by a hinge 18. In a preferred embodiment, the lid 16 is actuated open and closed by a lid actuator 19, such as a pneumatic cylinder, or a hydraulic cylinder, or the like. The cleaning receptacle 12 has an overflow port 20 that leads into an overflow duct 22 to carry away excess fluid when the fluid reaches the height of the overflow port 20. Likewise, the vertical receptacle has an overflow port 24 connected to an overflow duct 26 to carry away excess fluid when the fluid reaches the height of the vertical receptacle overflow port 24. The fluid is supplied to the vertical receptacle 14 by a supply conduit 28, which provides sufficient fluid flow to clean a tube or group of tubes. For example, a preferred embodiment provides a supply fluid flow of approximately 125 gallons per minute.

The cleaning receptacle and vertical receptacle are supported by a base plate 30 which slides along two rails 32, 34 to move the cleaning receptacle 12 and vertical receptacle 14 over three solution receptacles, or tanks, 36, 38, 40 that contain a cleaning solution, a first rinse solution, and a final rinse solution, respectively. In this embodiment, the base plate is moved by a drive system 42 that includes a screw-type drive 44, which is coupled to the base plate 30 to propel the base plate back and forth upon the two rails 32, 34. Position sensors 46, 48, 50 are installed on one of the two rails 32, 34 to sense when the base plate 30, and thus the vertical receptacle 14 and the cleaning receptacle 12, are aligned with one of the three solution tanks 36, 38, 40.

A drain port 52 from the cleaning receptacle 12 passes through the base plate 30, and a drain coupler 54 connects the drain port 52 to the solution tank 36, 38, or 40 with which the cleaning receptacle 12 is currently aligned. (See FIG. 5 for a detailed view of the drain port 52 and the drain coupler 54, which are described in more detail below.) The wash receptacle 36, the first rinse receptacle 38, and the final rinse receptacle 40 are placed in a secondary containment basin 56 to capture and contain any fluids that leak or spill from the wash receptacle, or tank, 36; the first rinse receptacle, or tank, 38; the second, or final, rinse receptacle, or tank, 40; the cleaning receptacle 12 or the vertical receptacle 14. In a preferred embodiment, the solution tanks 36, 38, 40 are constructed of welded polypropylene plastic, with an individual capacity of approximately 190 gallons, and include a removable lid.

A waste pump 57 is coupled to the first rinse receptacle to pump the fluid from the first rinse receptacle 38 out to a waste system. Additionally, a transfer pump 58 couples the first rinse receptacle 38 to the second, or final, rinse receptacle 40 so that the second rinse fluid in the second rinse receptacle 40 can be transferred to the first rinse receptacle 38. In a preferred embodiment of the disclosure, the waste pump 57 and the transfer pump 58 are diaphragm-type pumps, which are able to function with high concentrations of contaminants in the rinse fluids. However, in other embodiments, the waste pump 57 or the transfer pump 58 may include any suitable pump for transferring the first rinse fluid or the second rinse fluid, such as a screw-type or progressive cavity pump, a gear pump, a centrifugal pump, or the like.

In addition, an alternative embodiment includes a clean water pump 59 coupled to the second rinse receptacle 40 to replenish the second rinse fluid with clean water. The clean water pump 59 in an embodiment is a centrifugal pump, although other embodiments may include any suitable pump, such as a diaphragm pump, a gear pump, a screw-type pump, or the like. Nevertheless, some preferred embodiments do not include a clean water pump 59, but rather require a suitable external clean water supply. Thus, periodically, the second rinse fluid is replaced, partially replaced or replenished with clean water, and the previous second rinse fluid is then used to replenish the first rinse fluid, while at least part of the previous first rinse fluid is discharged to waste. In this way, the rinse fluids in the two rinse tanks 38, 40 are periodically refreshed.

Figure 2:
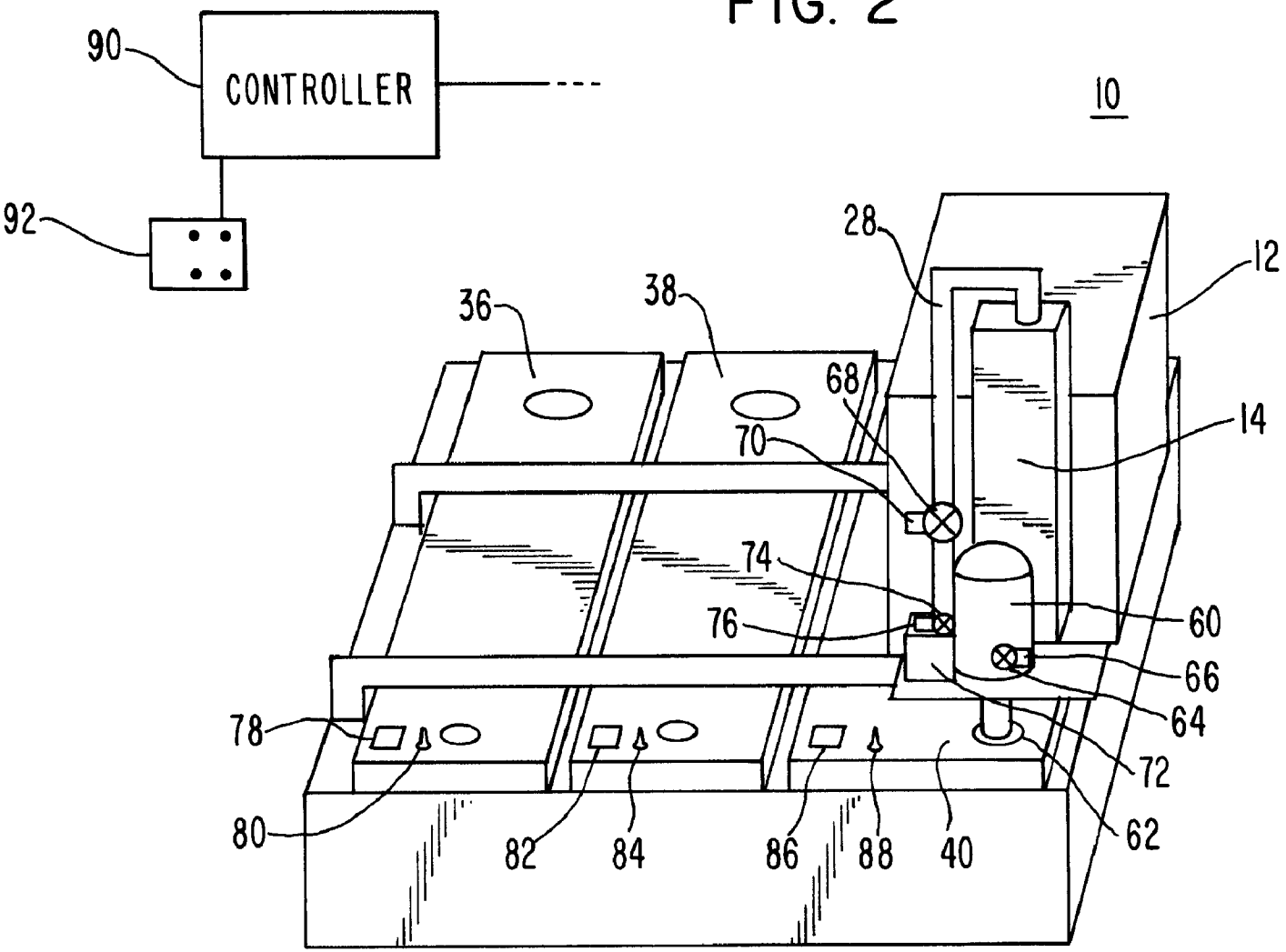
FIG. 2 is a perspective view from the opposite direction of the aqueous tube cleaning system in FIG. 1.

The aqueous tube cleaning apparatus 10 is also shown in FIG. 2 from the opposite direction. FIG. 2 shows a supply pump 60 coupled to the supply conduit 28 to pump fluid from one of the three solution tanks 36, 38, 40 into the vertical receptacle 14. A supply conduit coupler 62 is connected at an inlet end of the supply conduit 28, and may by extended to create a sealed connection with the currently adjacent solution tank 36, 38, 40. (See FIG. 6 for a detailed view of the supply conduit coupler 62, which is described in more detail below.)

The supply pump 60 includes a supply pump drain valve 64 with a supply pump drain valve actuator 66 to drain fluid, such as water or cleaning solution, from the supply pump 60. The supply pump drain valve 64 is opened before the supply pump priming cycle to clear most of the previous solution from the supply pump 60. A shut-off valve 68 and a shut-off valve actuator 70 is installed on the outlet side of the supply pump 60. This shut-off valve 68 is closed after the fluid has been drained from the supply pump 60 in order to allow the supply pump 60 to be primed. A vacuum chamber 72 is coupled to the supply pump 60 with a vacuum valve 74 and a vacuum valve actuator 76. When the shut-off valve 68 and the supply pump drain valve 64 are closed and the vacuum valve 74 is opened, the vacuum in the vacuum chamber 72 draws fluid through the inlet end of the supply conduit 28 from one of the solution tanks 36, 38, 40 into the supply pump 60 to prime the pump. Although the exemplary supply pump 60 used in this embodiment is a self-priming pump that requires a continuous liquid connection between the source tank and the pump body to initiate fluid flow, other embodiments may include any suitable pump, including a dry-priming pump that would not require the same priming system configuration.

A heating element 78 and a temperature sensor 80 are installed in the wash receptacle 36 to heat and sense the temperature of the cleaning solution fluid. Likewise, a heating element 82 and a temperature sensor 84 are installed in the first rinse tank 38, and a heating element 86 and a temperature sensor 88 are installed in the final rinse tank 40 to heat and sense the temperatures of the first rinse fluid and the final rinse fluid.

In addition, the aqueous tube cleaning apparatus 10 includes a controller 90 and an input device 92 to provide control for the electrical components of the tube cleaning apparatus 10. An example of a controller 90 that is compatible with the aqueous tube cleaning apparatus 10 is an Allen-Bradley Micrologics 1500 programmable logic controller, manufactured by Rockwell Automation, Inc., of Wisconsin, U.S.A. The controller 90 is coupled to the drive system 42 in order to control the movement and position of the base plate 30, and thus the cleaning receptacle 12 and the vertical receptacle 14. The controller 90 receives position signals from the position sensors 46, 48, 50 to signal the controller 90 when the cleaning receptacle 12 is aligned with one of the solution tanks, that is, the wash receptacle 36, the first rinse receptacle 38, or the final rinse receptacle 40, respectively.

The controller 90 also is coupled to the supply pump 60, the supply pump drain valve actuator 66, the shut-off valve actuator 70, and the vacuum valve actuator 76 to control the supply pump 60 and the supply pump priming system. After each clean or rinse cycle is completed, the controller 90 sends a control signal to the supply pump drain valve actuator 66 to open the supply pump drain valve 64, allowing fluid to drain from the supply pump 60. Then the controller 90 commands the supply pump drain valve actuator 66 to close the supply pump drain valve 64, and commands the shut-off valve actuator 70 to close the shut-off valve 68. With the supply pump drain valve 64 and the shut-off valve 68 closed, the controller 90 commands the vacuum valve actuator 76 to command the vacuum valve 74 to open, providing vacuum to the supply pump 60 in order to draw fluid through the inlet side of the supply conduit 28 and through the supply pump 60.

The controller also is coupled to the three heating elements 78, 82, 86 and to the three temperature sensors 80, 84, 88. The controller 90 receives temperature signals from the temperature sensors 80, 84, 88, and in response individually controls the heating elements 78, 82, 86 in order to maintain the fluid temperature in each of the solution tanks 36, 38, 40 within a specified range, as required for the cleaning application. For example, in a preferred embodiment the fluid temperature in each of the solution tanks 36, 38, 40 is continuously maintained between 130° F. and 140° F. Additionally, in a preferred embodiment, the controller 90 is configured to alert an over-temperature condition in the wash receptacle 36, the first rinse receptacle 38, or the final rinse receptacle 40 when the temperature signal received from one of the temperature sensors 80, 84, 88 is greater than 70° C. (158° F.). Likewise, level sensors are installed in the solution tanks 36, 38, 40 to sense the levels of fluid in each tank. For example in a preferred embodiment, a four-position float switch in each of the solution tanks 36, 38, 40 senses a fluid rise of 2.7 inches (empty), a fluid rise of 7 inches (heater immersed), a fluid rise of 13 inches (refresh level), and a fluid rise of 15 inches (full).

In a preferred embodiment, the controller 90 is further coupled to the waste pump 57, the transfer pump 58 and the clean water pump 59. In this embodiment, the controller 90 is configured to automatically refresh the first and second rinse fluids at specified times on specified days. Alternative embodiments refresh the first and second rinse fluids according to other schedules, for example, after a predetermined number of cycles or after a predetermined amount of time.

The input device 92 is coupled to the controller 90 to provide control inputs to the controller 90. For example, in a preferred embodiment of the disclosure, the input device includes a CYCLE START button to initiate a clean and rinse cycle, a CYCLE STOP button to halt to end a clean and rinse cycle, an E-STOP button to halt operation of the tube cleaning system 10 in an emergency, and an E-STOP RESET button to allow the tube cleaning system 10 to return to normal operation after an emergency stop. However, other embodiments of the disclosure include any suitable inputs required to provide additional desired control functions. The input device shown in FIG. 1 is an electromechanical push-button type switch control panel. However, other embodiments may include any type of input device, including a digital pad, a keypad, touch screen, audio recognition system, or the like. Furthermore, the input device 92 may include a visual display device in order to provide additional output to an operator. As an example of an input device that is compatible with the aqueous tube cleaning apparatus 10, a preferred embodiment includes an Allen-Bradley Panelview 300 Micro digital pad with display.

Figure 3:
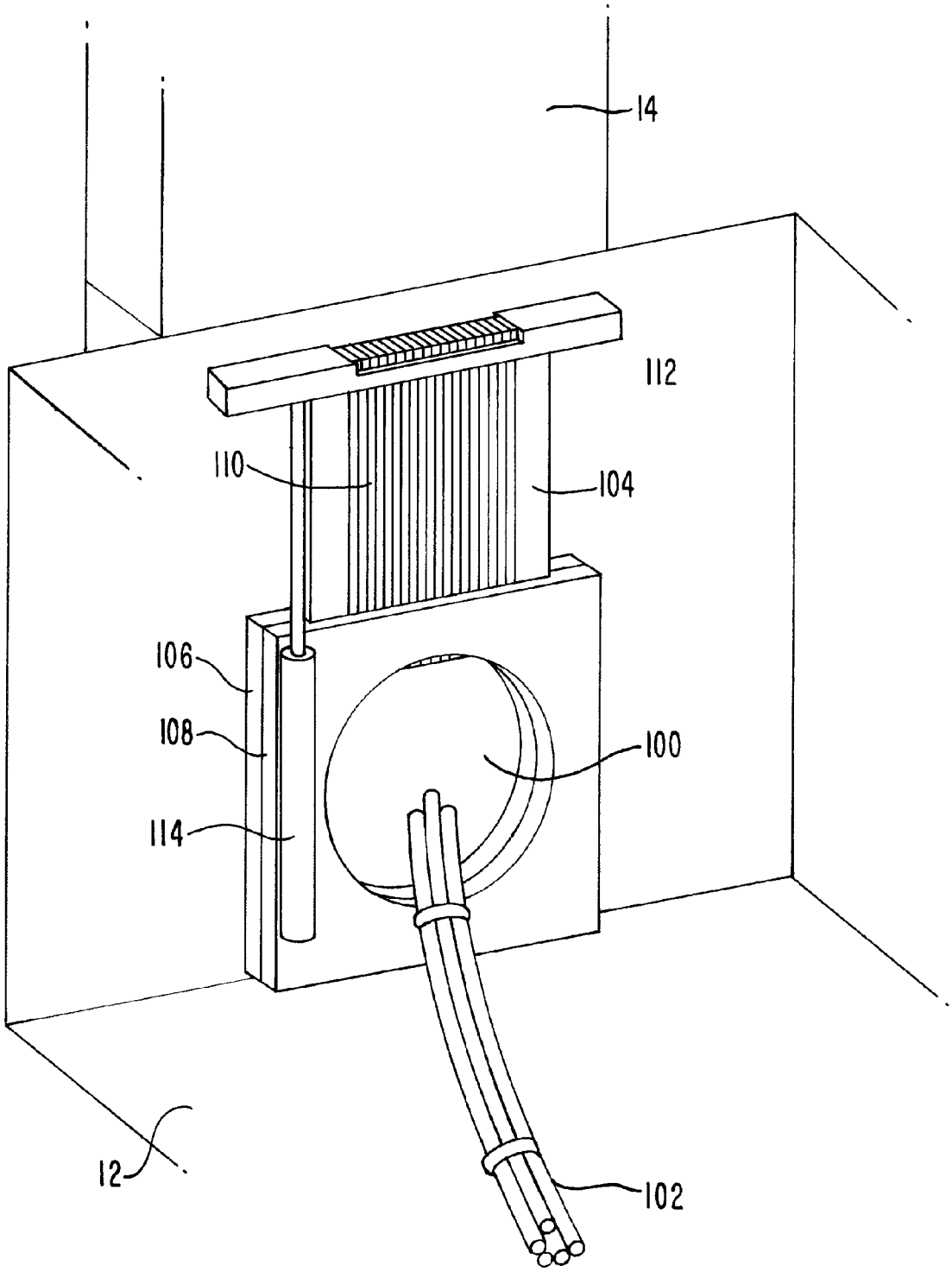
FIG. 3 is a partial cutaway view of a cleaning receptacle in accordance with a preferred embodiment of the disclosure, showing an inlet port with bundled tubing to be cleaned.

As shown in FIG. 3, an inlet port 100 connects the vertical receptacle 14 with the cleaning receptacle 12 to provide fluid communication between the two receptacles 12, 14. A tube or a group, or bundle, of tubes 102 is placed so that it extends through the inlet port 100, and then a gate 104 slides closed to clamp the tube or tube bundle 102 into place. For example, in a preferred embodiment, tubes typically are bundled into groups of 7-9 tubes. The gate 104 is slidably attached to the cleaning receptacle 12 and held in place by two flange plates 106, 108. The gate includes a number of individual elements 110. The individual elements 110 of the gate 104 are relatively long and slender, of rectangular cross-section. The elements 110 are placed adjacent one another and pressed together by the flange plates 106, 108 and a yoke 112.

The yoke 112 is actuated by a gate actuator 114. In a preferred embodiment, the gate actuator 114 includes a pneumatic cylinder. In other embodiments, the gate actuator 114 may include any suitable actuator, for example, a hydraulic cylinder, a torque motor, or the like. The gate 104 is actuated by means of the yoke 112, which has an interference fit with the gate elements 110. When the yoke 112 is actuated in the opening direction, the yoke 112 engages a lip, or shoulder, near the upper end of the elements 110 to raise the elements 110 and open the gate 104. When the yoke 112 is actuated in the closing direction, the gate elements 110 are actuated in the closing direction by the friction between the yoke 112 and the gate elements 110, and between the gate elements 110, and by gravity, such that the individual elements 110 slide as a single unit, closing the gate 104 until the individual elements 110 contact a tube or a bundle of tubes 102.

Figure 4:
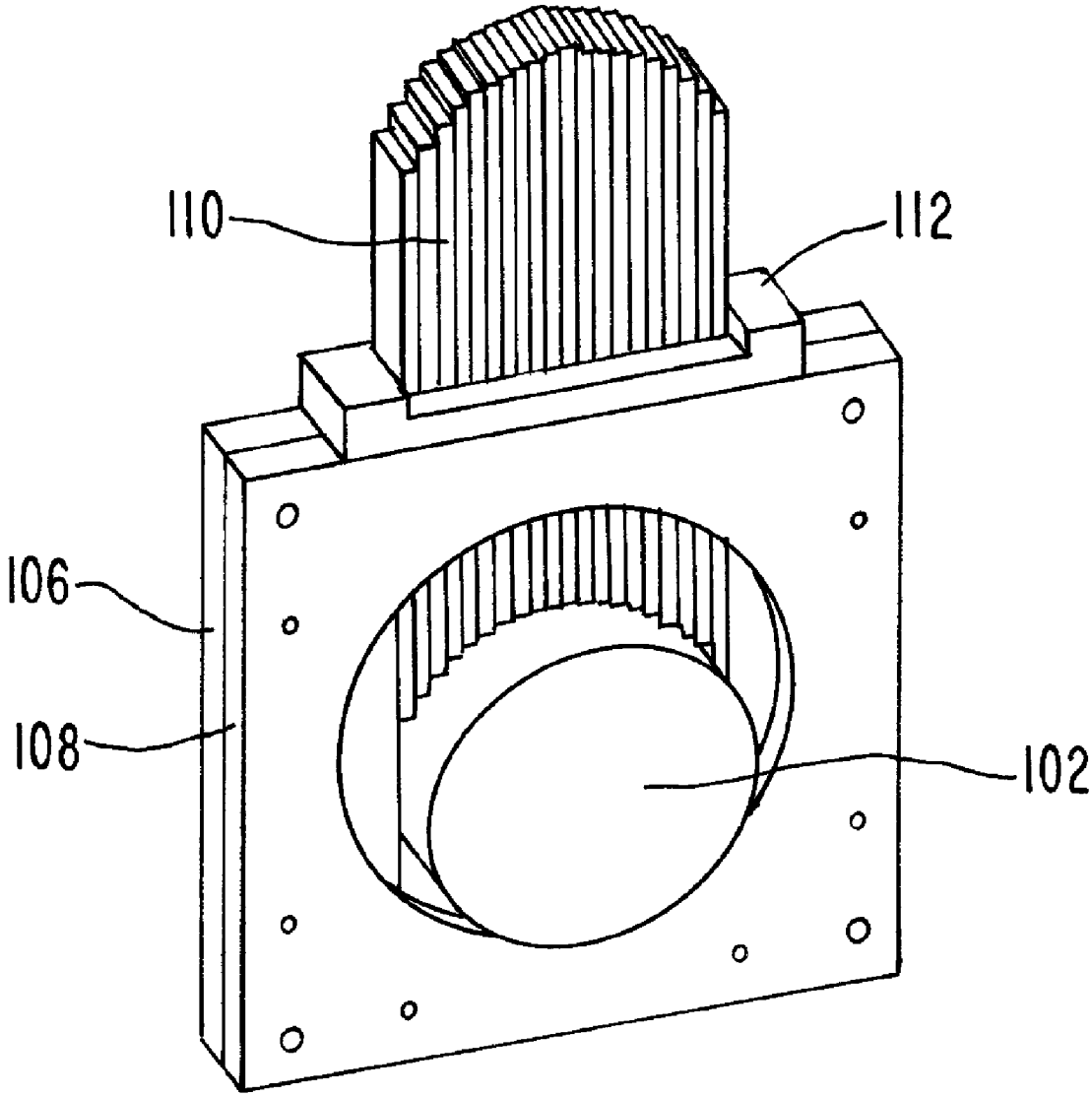
FIG. 4 is a perspective view illustrating an inlet port gate clamping a tube in place in an inlet port.

As shown in FIG. 4, the individual elements 110 stop against the outer wall of the tube or bundle of tubes 102, the friction created by the interference fit between the yoke 112 and the gate elements 110, the friction between the individual elements 110, and the weight of the elements 110 placing a clamping force on the tube or bundle of tubes 102. In this way, the gate 104 generally conforms to the shape or contour of the outer surface of the tube or bundle of tubes 102 in order to clamp the tube or bundle of tubes 102 in place and substantially close the remainder of the inlet port 100 to inhibit fluid flow through the inlet port 100 from the vertical receptacle 14 into the cleaning receptacle 12.

Figure 5:
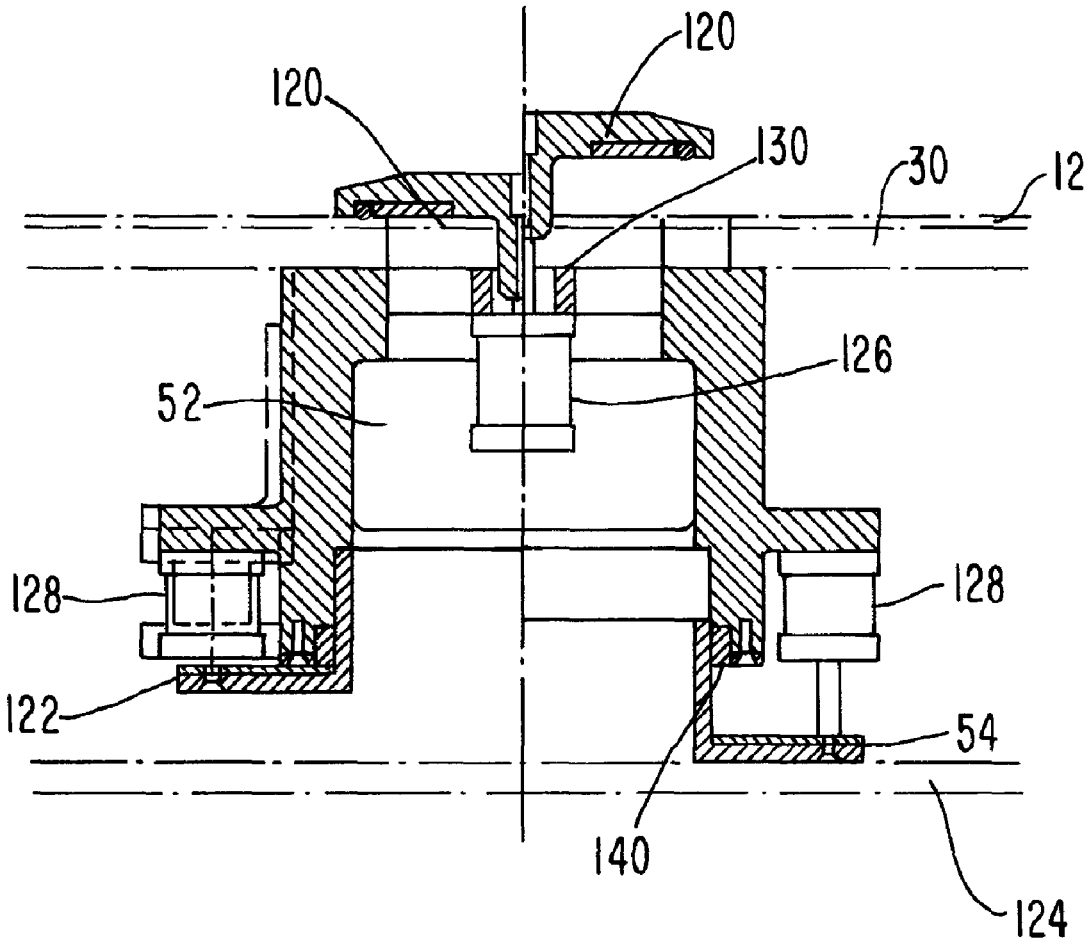
FIG. 5 is a cutaway view of a drain valve and drain coupler assembly.

The cleaning receptacle 12 drain port 52 is opened and closed by a drain valve 120, shown in FIG. 5. The drain valve 120 shown is an air poppet valve; however, other embodiments include any suitable valve assembly. In a preferred embodiment, the drain is sized such that approximately 16 to 18 inches of water depth is required in the cleaning tank 12 in order to match the drain flow to the flow of the supply conduit. Nevertheless, in other embodiments, the drain valve 120 may be sized to meet other design criteria. The left half of FIG. 5 shows the drain valve 120 in the closed position, and the right half of FIG. 5 shows the drain valve 120 in the open position. A drain valve actuator 126 provides the force to open and close the drain valve 120. For example, in a preferred embodiment, the drain valve actuator 126 consists of a pneumatic cylinder. In other embodiments, the drain valve actuator 126 may include any suitable actuator, such as a hydraulic cylinder, a torque motor, or the like.

A slidable drain coupler 54 extends to create a sealed connection with one of the solution tanks 36, 38, 40, as shown in the right half of FIG. 5. FIG. 5 shows the lower surface of the cleaning receptacle 12 and the base plate 30, as well as the upper surface or lid 124 of a solution tank 36, 38, 40. A drain coupler actuator 128 provides the force to extend and retract the drain coupler 54. The drain coupler 54 retracts as shown in the left half of FIG. 5, in order to allow the cleaning receptacle 12 to be moved from one solution tank 36, 38, 40 to another. In a preferred embodiment, the drain coupler actuator 128 also is a pneumatic cylinder. However, in other embodiments, the drain coupler actuator 128 may include any suitable actuator, such as a hydraulic cylinder, or the like.

In a preferred embodiment, a position sensor 130 provides a position signal representing the position of the drain valve 120 to the controller 90. Thus the controller 90 does not command the drive system 42 to move the cleaning receptacle 12 unless the drain valve 120 is in the closed position. Likewise, in a preferred embodiment, a position sensor 140 provides a position signal representing the position of the drain coupler 54 to the controller 90, and the controller does not command the drive system 42 to move the cleaning receptacle 12 unless the drain coupler 54 is in the retracted position.

Figure 6:
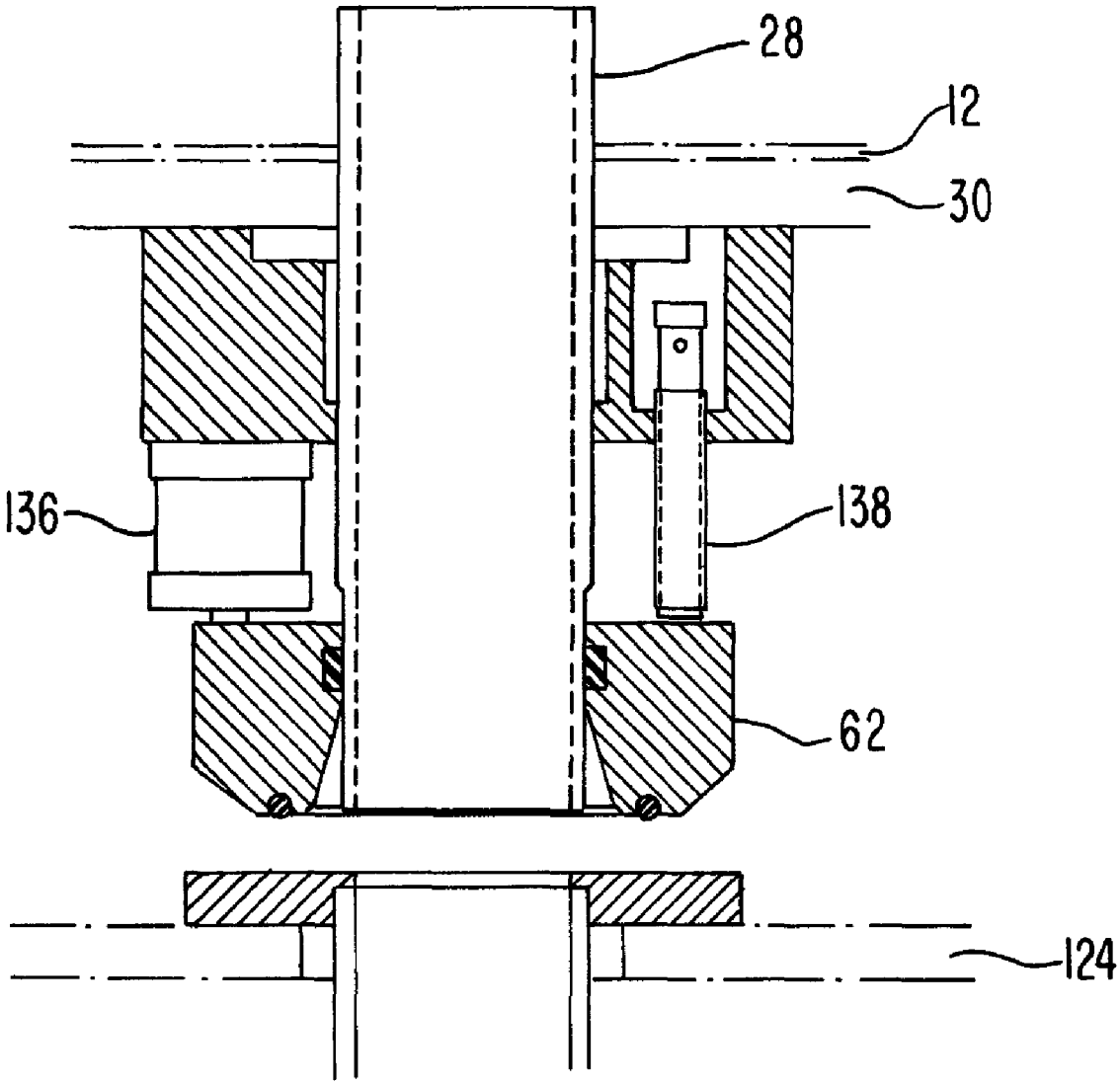
FIG. 6 is a cutaway view of a supply conduit coupler.

FIG. 6 shows the supply conduit coupler 62 which is coupled to the supply conduit 28. The supply conduit 28 passes through the lower surface of the cleaning receptacle 12 and through the base plate 30 and is coupled to one of the solution tanks 36, 38, 40 by the supply conduit coupler 62. The force to extend or retract the supply conduit coupler 62 is provided by a supply coupler actuator 136. For example, in a preferred embodiment the supply coupler actuator 136 includes a pneumatic cylinder. However, in other embodiments, the supply coupler actuator 136 may be any suitable actuator, for example, a hydraulic cylinder, a torque motor, or the like. In addition, a position sensor 138 senses the position of the supply conduit coupler 62 and sends a representative signal to the controller 90. Thus, the controller 90 does not command the drive system 42 to move the cleaning receptacle 12 unless the supply conduit coupler 62 is in the retracted position.

In operation, the aqueous tube cleaning apparatus 10 is configured to automatically perform a complete clean and rinse cycle. The tube or bundle of tubes 102 is installed in the cleaning tank 12 by an operator. The operator then pushes the CYCLE START push button on the input device 92, signaling the gate actuator 114 to actuate the gate 104 toward the closed position, and the cleaning tank lid actuator 19 to actuate the lid 16 to the closed position. In a preferred embodiment, tubes that require internal flushing to remove contaminants—for example, tubes having a diameter of one inch or less—are placed through the inlet port 100 between the cleaning tank 12 and the vertical tank 14 and clamped into place by the gate 104. Larger tubes—for example, tubes having a diameter greater than one inch—are placed in the cleaning tank 12 so that water flowing through the cleaning tank 12 will remove contaminants from the inner surface and the outer surface of the large diameter tubes.

When the operator pushes the CYCLE START button on the input device 92, the controller 90 commands the heating elements 78, 82, 86 to warm the cleaning solution fluid in the wash tank 36, the first rinse fluid in the first rinse tank 38, and the final rinse fluid in the final rinse tank 40. The controller 90 receives temperature signals from the temperature sensors 80, 84, 88 indicating the temperature of the cleaning solution fluid, the first rinse fluid and the final rinse fluid, respectively. The controller 90 monitors the temperature signals from temperature sensors 80, 84, 88 continuously during the wash and rinse cycle to maintain the temperatures of the cleaning solution fluid, the first rinse fluid and the final rinse fluid with a predetermined range, for example, between 130° F. and 140° F.

After verifying that the wash solution temperature is within the prescribed range, the controller 90 commands the drive system 42 to move the cleaning receptacle 12 into alignment with the wash tank 36. The controller then actuates the drain coupler 54 and the supply conduit coupler 62 to their extended positions to seal each the drain port 52 and the supply conduit 28 to the wash tank 36. The controller then closes the shut-off valve 68 and opens the vacuum valve 74 to draw fluid into the supply pump 60 to prime the pump. The controller 90 then closes the vacuum valve 74, starts the supply pump 60 and opens the shut-off valve 68 to provide cleaning solution fluid to the vertical tank 14.

As the cleaning solution fluid level in the vertical tank 14 rises, the pressure at the bottom of the vertical tank 14 increases and the cleaning solution fluid is forced by the pressure created by gravity through the tube or bundle of tubes 102 into the cleaning tank 12. When the cleaning solution reaches the height of the overflow port 24, the fluid also flows from the vertical tank 14 through the overflow duct 26 into the cleaning tank 12. The cleaning solution fluid flows both through the tube or bundle of tubes 102 and around the tube or bundle of tubes 102 in order to clean the inner surface as well as the outer surface of the tube or bundle of tubes 102. When the fluid in the cleaning tank 12 reaches the height of the overflow port 20, the cleaning solution flows from the cleaning tank 12 through the overflow duct 22, bypassing the drain valve 54, into the drain coupler 54, and is thus recirculated into the cleaning tank 36. In a preferred embodiment, the cleaning solution is allowed to flow from the vertical tank 14 into the cleaning tank 12 for a five minute period. However, the wash and rinse time periods may be adjusted by way of the operator interface input device 92.

When the clean cycle is finished, the controller 90 commands the supply pump 60 off and opens the supply pump drain valve 66 and the drain valve 120 so the cleaning solution fluid will drain from the supply pump 60 and the cleaning receptacle 12. This process has the advantage that cross-contamination between the solution tanks 36, 38, 40 is minimized, thereby maximizing the useful life of the first and final rinse solutions. The controller then commands the drain coupler 54 and the supply conduit coupler 62 to the retracted position, and commands the drive system 42 to move the cleaning tank 12 into alignment with the first rinse tank 38.

As before, the controller commands the supply coupler 62 and the drain coupler 54 to the extended position to seal the drain port 52 and the supply conduit 28 to the first rinse tank 38. The controller 90 closes the supply pump drain valve 66 and the shut-off valve 68, and then opens the vacuum valve 74 to draw the first rinse fluid into the supply pump 60 to prime the supply pump 60. The controller 90 then commands the shut-off valve 68 open and the vacuum valve 74 closed, and starts the supply pump 60. The first rinse fluid is pumped through the supply conduit 28 into the vertical tank 14, and as the first rinse fluid rises, the pressure created by gravity forces the first rinse fluid through and around the tube or bundle of tubes 102 into the cleaning tank 12.

The first rinse cycle is allowed to continue for a predetermined period—for example, in a preferred embodiment, two minutes—and then the controller 90 commands the supply pump 60 off and the supply pump drain valve 66 open. The controller 90 also commands the drain valve 120 open to drain the first rinse fluid from the cleaning tank 12. The controller 90 then recloses the drain valve 120 and the supply pump drain valve 66, and commands the supply coupler 62 and the drain coupler 54 to the retracted position. Then the controller 90 commands the drive system 42 to move the cleaning tank 12 into alignment with the second rinse tank 40.

At the second rinse tank, the controller commands the supply coupler 62 and the drain coupler 54 to the extended position to seal the supply conduit 28 and the drain port 52 in connection with the final rinse tank 40. The controller 90 then commands the shut-off valve 68 closed and the vacuum valve 74 open to prime the supply pump 60. The controller then closes the vacuum valve 74, opens the shut-off valve 68 and starts the supply pump 60 to provide final rinse fluid to the vertical tank 14 through the supply conduit 28. As the final rinse fluid rises in the vertical tank 14, the final rinse fluid is forced by the pressure created by gravity through and around the tube or bundle of tubes 102 into the cleaning tank 12.

The controller allows the final rinse cycle to continue for a predetermined period—for example, in a preferred embodiment, two minutes—and then commands the supply pump 60 off. The controller opens the supply pump drain valve 66 and the drain valve 120 to allow the final rinse fluid to drain from the supply pump 60 and from the cleaning tank 12, and then recloses the supply pump drain valve 66 and the drain valve 120. The controller 90 then commands the supply coupler 62 and the drain coupler 54 to the retracted position to end the final rinse cycle. At this point, one complete clean and rinse cycle has been completed and the controller 90 commands the gate actuator 114 to actuate the gate 104 in the open direction, then commands the cleaning tank lid actuator 19 to actuate the lid 16 to the open position, so that an operator may remove the tube or bundle of tubes 102 from the cleaning tank 12.

The many features and advantages of the disclosure are apparent from the detailed specification, and thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

What is claimed is:

1. A method of cleaning at least one tube being open on both ends and having an inner surface and an outer surface, comprising the steps of:

installing the tube in a cleaning receptacle connected to a vertical receptacle, the vertical receptacle being taller than the cleaning receptacle;

aligning the cleaning receptacle and vertical receptacle with a tank containing a fluid;

supplying the fluid to the vertical receptacle; and forcing the fluid in the vertical receptacle to flow under pressure created by gravity through and around the tube to clean the inner and outer surfaces of the tube.

2. The method of claim 1, further comprising the step of:

clamping the tube in place through an inlet port located between the vertical receptacle and the cleaning receptacle.

3. The method of claim 2, wherein the step of clamping the tube in place through the inlet port comprises:

sliding individual elements of a gate into contact with the tube.

4. The method of claim 3, wherein:

the individual elements are contiguously aligned and slidable relative to one another such that when the gate is closed, the individual elements generally conform to a contour of the outer surface of the tube.

5. The method of claim 1, wherein:

the tube comprises a bundle of tubes.

6. The method of claim 1, wherein:

the tank comprises a wash tank containing a cleaning solution fluid;

the step of supplying the fluid to the vertical receptacle comprises:

pumping the cleaning solution fluid into the vertical receptacle.

7. The method of claim 6, further comprising the step of:
draining the cleaning solution fluid from the cleaning receptacle after forcing the cleaning solution fluid to flow through and around the tube.

8. A method of cleaning at least one tube having an inner surface and an outer surface, comprising the steps of:
installing the tube in a cleaning receptacle connected to a vertical receptacle, the vertical receptacle being taller than the cleaning receptacle;
supplying a fluid to the vertical receptacle;
forcing the fluid in the vertical receptacle to flow through and around the tube to clean the inner and outer surfaces of the tube;
moving the cleaning receptacle and vertical receptacle successively over at least two solution tanks, each solution tank containing fluid; and
stopping the cleaning receptacle and vertical receptacle at each solution tank and pumping the fluid from the solution tank into the vertical receptacle.

9. The method of claim 8, wherein the solutions tanks comprise a first rinse tank and a second rinse tank containing first and second rinse fluids, respectively, the method further comprising the steps of:
pumping the first rinse fluid from the first rinse tank to a waste system;
transferring the second rinse fluid from the second rinse tank to the first rinse tank; and
replenishing the second rinse tank.

10. The method of claim 8, further comprising the step of:
maintaining a temperature of the fluid in at least one of the solution tanks within a predetermined range.

11. A method of cleaning at least one tube having an inner surface and an outer surface, comprising the steps of:
clamping the tube in place through an inlet port located between a vertical receptacle and a cleaning receptacle, the vertical receptacle being taller than the cleaning receptacle;
aligning the cleaning receptacle and vertical receptacle with a tank containing a fluid;
supplying the fluid to the vertical receptacle;
creating pressure in the fluid due to gravity; and
channeling the fluid to flow through and around the tube under pressure of gravity to clean the inner and outer surfaces of the tube.

12. The method of claim 11, wherein:
the tank comprises a wash tank containing a cleaning solution fluid;
the step of supplying the fluid to the vertical receptacle comprises:
pumping the cleaning solution fluid into the vertical receptacle.

13. The method of claim 12, further comprising the step of:
draining the cleaning solution fluid from the cleaning receptacle into the wash tank after channeling the cleaning solution fluid through and around the tube.

14. A method of cleaning at least one tube having an inner surface and an outer surface, comprising the steps of:
clamping the tube in place through an inlet port located between a vertical receptacle and a cleaning receptacle, the vertical receptacle being taller than the cleaning receptacle;
supplying a fluid to the vertical receptacle;
channeling the fluid through and around the tube to clean the inner and outer surfaces of the tube;
moving the cleaning receptacle and vertical receptacle successively over at least two solution tanks, each solution tank containing fluid;
sensing when the vertical receptacle and cleaning receptacle are aligned with each of the solution tanks; and
stopping the cleaning receptacle and vertical receptacle at each solution tank and pumping the fluid from the solution tank into the vertical receptacle.

15. The method of claim 14, further comprising the step of:
heating the fluid in at least one of the solution tanks.

16. The method of claim 14, wherein the solutions tanks include a first rinse tank and a second rinse tank containing first and second rinse fluids, respectively, the method further comprising the steps of:
pumping the first rinse fluid from the first rinse tank to a waste system;
transferring the second rinse fluid from the second rinse tank to the first rinse tank; and
replenishing the second rinse tank.

17. A method of cleaning a tube having an inner surface and an outer surface, comprising the steps of:
clamping the tube in place through an inlet port located between a vertical receptacle and a cleaning receptacle by sliding individual elements of a gate into contact with the tube, the vertical receptacle being taller than the cleaning receptacle;
providing a cleaning solution fluid from a wash tank to the vertical receptacle;
channeling the cleaning solution fluid to flow under pressure created by gravity through and around the tube to clean the inner and outer surfaces of the tube;
draining the cleaning solution fluid from the cleaning receptacle;
aligning the cleaning receptacle and the vertical receptacle with a first rinse tank containing a first rinse fluid;
pumping the first rinse fluid into the vertical receptacle such that the first rinse fluid flows through and around the tube;
draining the first rinse fluid from the cleaning receptacle;
aligning the cleaning receptacle and the vertical receptacle with a second rinse tank containing a second rinse fluid;
providing the second rinse fluid to the vertical receptacle such that the second rinse fluid flows through and around the tube; and
draining the second rinse fluid from the cleaning receptacle into the second rinse tank.

18. The method of claim 17, further comprising the step of:
draining the cleaning solution fluid and the first and second rinse fluids from a supply pump when the fluids are drained from the cleaning receptacle.

19. The method of claim 17, further comprising the step of:
heating and maintaining a temperature of at least one of the cleaning solution fluid and the first and second rinse fluids within a predetermined range.

20. A method of cleaning a tube having inner and outer surfaces using an aqueous tube cleaning system comprising a cleaning receptacle, a vertical receptacle, an inlet port located between the cleaning receptacle and vertical receptacle, and a gate for opening and closing the inlet port, the vertical receptacle being taller than the cleaning receptacle, the method comprising the steps of:
installing the tube in the cleaning receptacle such that the tube extends through the inlet port and into the vertical receptacle;
clamping the tube in place through the inlet port by sliding individual elements of the gate into contact with the tube;
pumping a cleaning solution fluid from a wash tank into the vertical receptacle using a supply pump;

increasing the pressure at a bottom of the vertical tank as the cleaning solution fluid level rises in the vertical tank;

forcing the cleaning solution fluid under the pressure created by gravity through and around the tube to clean the inner and outer surfaces of the tube;

draining the cleaning solution fluid from the cleaning receptacle and from the supply pump;

aligning the cleaning receptacle and the vertical receptacle with a first rinse tank containing a first rinse fluid;

pumping the first rinse fluid into the vertical receptacle using the supply pump such that the first rinse fluid flows through and around the tube;

draining the first rinse fluid from the cleaning receptacle and from the supply pump;

aligning the cleaning receptacle and the vertical receptacle with a second rinse tank containing a second rinse fluid;

pumping the second rinse fluid to the vertical receptacle using the supply pump such that the second rinse fluid flows through and around the tube; and draining the second rinse fluid from the cleaning receptacle and from the supply pump.

* * * * *